US006807939B1

(12) United States Patent
Doelker et al.

(10) Patent No.: US 6,807,939 B1
(45) Date of Patent: Oct. 26, 2004

(54) CONTROL SYSTEM FOR PROTECTING AN INTERNAL COMBUSTION ENGINE FROM OVERLOADING

(75) Inventors: Armin Doelker, Immenstaad (DE); Thomas Spaegele, Tettnang (DE); Klaus Wehler, Friedrichshafen (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 38 days.

(21) Appl. No.: 10/129,561

(22) PCT Filed: Nov. 7, 2000

(86) PCT No.: PCT/EP00/10972

§ 371 (c)(1),
(2), (4) Date: May 8, 2000

(87) PCT Pub. No.: WO01/34959

PCT Pub. Date: Mar. 17, 2001

(30) Foreign Application Priority Data

Nov. 9, 1999 (DE) ..... 199 53 767

(51) Int. Cl.[7] ..... F02D 31/00

(52) U.S. Cl. ..... 123/350; 123/357; 123/480; 701/110

(58) Field of Search ..... 123/350, 352, 123/357, 361, 399, 435, 478, 480, 488; 701/102, 103, 110

(56) References Cited

U.S. PATENT DOCUMENTS

| | | | | |
|---|---|---|---|---|
| 5,623,906 A | * | 4/1997 | Storhok | 123/399 X |
| 6,098,592 A | | 8/2000 | Hess et al. | 123/350 |
| 6,223,721 B1 | | 5/2001 | Bauer et al. | 123/399 |
| 6,263,856 B1 | * | 7/2001 | Weber et al. | 123/352 |
| 6,285,946 B1 | | 9/2001 | Steinmann | 701/110 |

FOREIGN PATENT DOCUMENTS

| | | |
|---|---|---|
| DE | 19515481 A1 | 10/1996 |
| DE | 19739564 A1 | 3/1999 |
| DE | 19748355 A1 | 5/1999 |
| EP | 0875673 A2 | 11/1998 |
| EP | 0853723 B1 | 1/2000 |

* cited by examiner

*Primary Examiner*—Tony M. Argenbright
(74) *Attorney, Agent, or Firm*—Crowell & Moring LLP

(57) ABSTRACT

A control system for protecting an internal combustion engine from overloading. The output of the internal combustion engine is adjusted with an output-determining signal according to an input signal which characterizes the desired output. According to the invention, a differential torque is calculated from the current motor torque and a maximum permissible motor torque. The differential torque in turn determines an authoritative second signal. A first signal that is determined from an input signal characterizing the desired output and the second signal are directed to a selector which selects the first or second signal as the signal that determines the output.

58 Claims, 7 Drawing Sheets

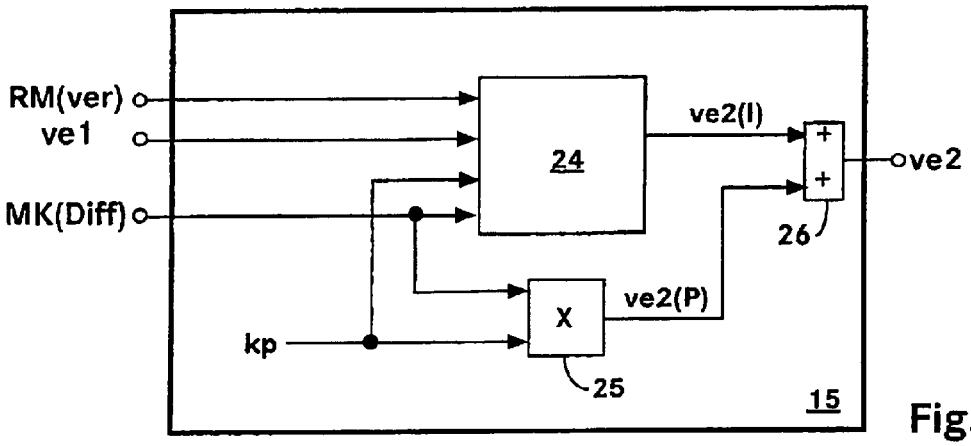
Fig. 4
| | RM(ver) | MK(Diff) | aktiv |
|---|---|---|---|
| Controller 1 dominant | 1 | > L1 | C / A |
| | 1 | < L1 | C / B |
| Controller 2 dominant | 0 | < L1 | D / B |
| | 0 | > L1 | D / B |
Fig. 5
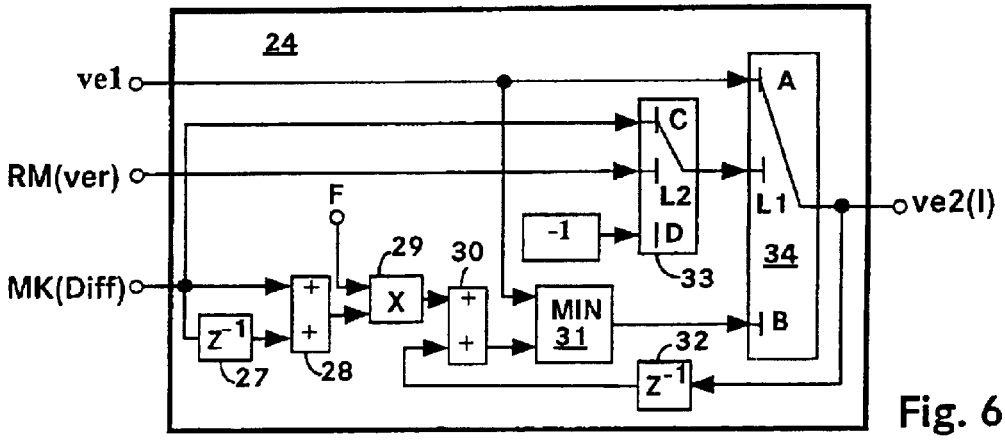
Fig. 6

CONTROL SYSTEM FOR PROTECTING AN INTERNAL COMBUSTION ENGINE FROM OVERLOADING

BACKGROUND AND SUMMARY OF THE INVENTION

The invention relates to a control system for protecting from overloading an internal combustion engine whose output is set, with an output-determining signal, as a function of an input signal that characterizes the desired output.

German Patent 195 15 481 A1 discloses a control system, in which a desired output is specified via a selection lever. From this an engine speed target is calculated for a speed closed-loop control circuit and a helix angle target is calculated for a load-regulating step. The engine speed controller calculates from the system deviation an injected fuel quantity as well as the difference between it and the maximum possible injected fuel quantity. This difference is routed to the load-regulating step. The load-regulating step controls a regulating propeller as a function of the helix angle target, the injected-fuel quantities and the engine speed gradients. In this system, however, the output torque of the internal combustion engine is not taken into consideration. Changed boundary conditions, for example higher fuel quality or rapid increases in load at the output, bring about high engine torque values, which can be above the values specified by the engine manufacturer and cause damage to the internal combustion engine.

Based on the related art described above, the object of the present invention is to further develop a more certain protection of the internal combustion engine.

The objective is achieved according to the present invention by a control system in which a differential torque is calculated from the current engine torque and a maximum permissible engine torque. The differential torque in this situation in large part determines a second signal. The second signal and a first signal determined from the desired output are routed to a selecting means. The selecting means are used to set the first or second signal as the output-determining signal. An "output-determining signal" in the sense of the invention is an injected-fuel quantity or a travel path of a control rod. In an embodiment the selecting means contain a minimum value selection. The minimum value selection is used to set the signal whose pulse value is lowest as the output-determining signal.

In an embodiment, the first signal is determined via a first controller, or alternatively, via a function block. The second signal, in turn, is determined via a second controller.

The control system of the present invention is configured such that the first signal represents the output-determining signal. The output of the internal-combustion engine is determined by the first controller or by a function block as a function of the desired output, i.e., it is in speed mode. If the torque output of the internal combustion engine exceeds the maximum permissible engine torque, the value of the second signal drops below the value of the first signal. A change in the dominance to the second controller then occurs via the selecting means. The second controller determines via the second signal the output of the internal combustion engine, i.e. it is in torque-limit-controller mode, hereinafter referred to as MBR mode. On the basis of the system deviation, the second controller reduces the output torque via the reduction of the output-determining signal until it falls below the maximum permissible engine torque . After that, a switch back to the first controller takes place.

In order to avoid erratic changes of the output-determining signals when changing dominance, the two control circuits are coupled with each other, wherein the integral-action component of the second controller is either set to the value of the first signal or limited, in dependency upon the differential torque.

The solution of the present invention and its embodiment offer the advantage that in the case of a rapidly increasing torque at the output, for example with the re-entry of a waterjet drive, there is a targeted reaction, since the output-determining signal is reduced. The internal combustion engine is effectively protected this way from overloading.

Another advantage is that the internal combustion engine is easier to tune. As is generally known, the individual parameters of the internal combustion engine, for example the limit value line (DBR curve) of the maximum permissible injected fuel quantity, are determined for each internal combustion engine in test bench trials. However, these applied data values differ from one internal combustion engine to another of the same type, and are valid only for the predetermined boundary conditions. By contrast, the invention opens the possibility of being able to use identical data values, and specifically that the maximum engine torque is delivered under all possible boundary conditions. If the measured engine torque is greater than the maximum permissible engine torque, then the second controller performs a correction in the sense of a reduction of the output-determining signal.

The control system represented in the invention can be used with internal combustion engines in the common rail design, the UIS design (unit injector system) or conventional design.

BRIEF DESCRIPTION OF THE DRAWINGS

A preferred exemplary embodiment is shown in the figures. Shown are:

FIG. 4 is a block diagram of the second controller.

FIG. 5 is a table for the calculation of integral-action component.

FIG. 6 is a block diagram calculation integral-action component.

DETAILED DESCRIPTION OF THE DRAWINGS

Figure 1:
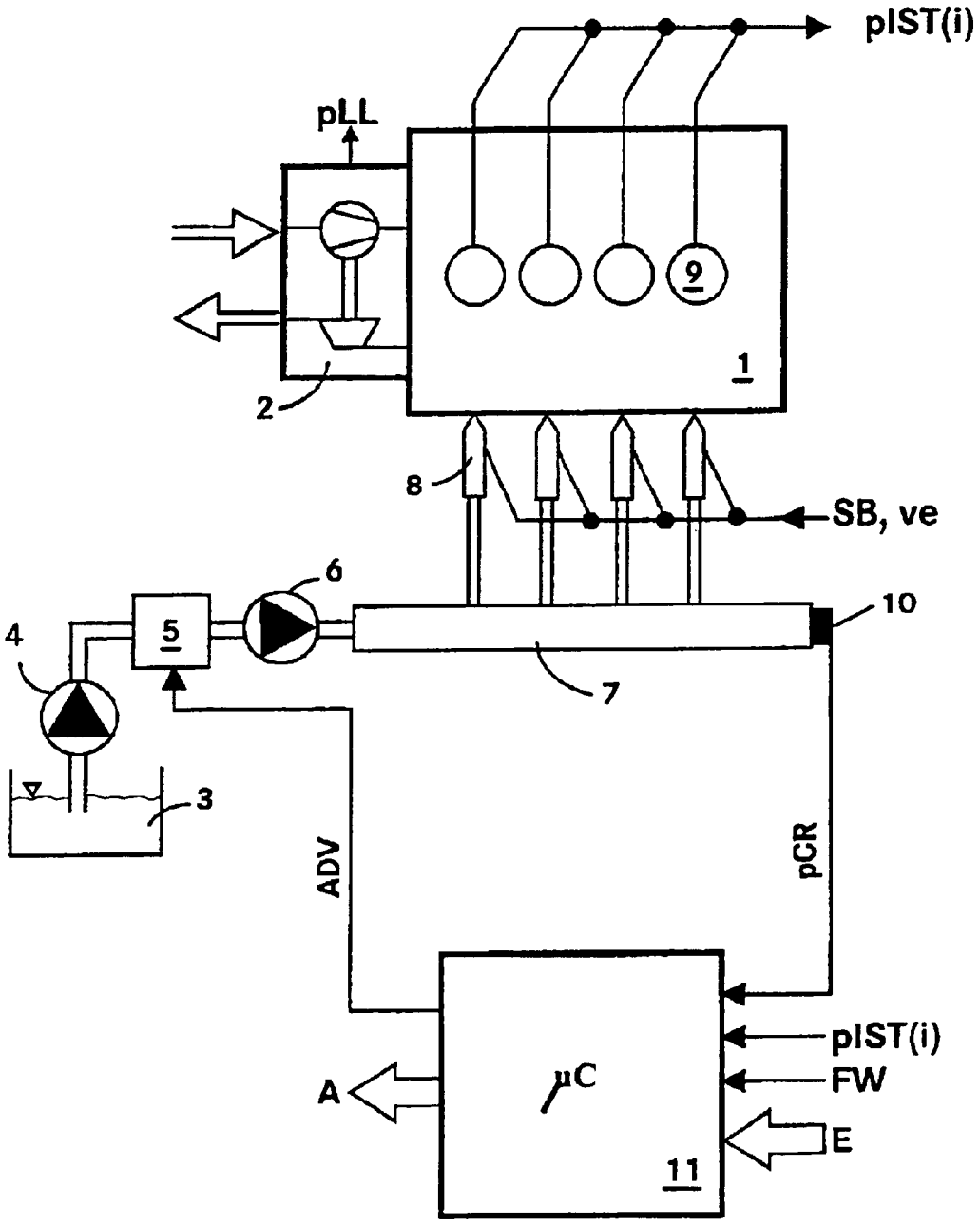
FIG. 1 is a diagram of an internal combustion engine with an accumulator fuel injection system.

Illustrated in FIG. 1 is a block diagram of an internal combustion engine with an accumulator fuel injection system (common rail). It shows an internal combustion engine 1 with turbocharger and charge-air cooler 2, an electronic engine control unit 11, a first pump 4, a second pump 6, a high-pressure accumulator (rail) 7, and connected thereto injectors 8 and a throttle valve 5. First pump 4 delivers the fuel from fuel tank 3 via the throttle valve 5 to second pump 6, which in turn delivers the fuel under high pressure into the high-pressure accumulator 7. The pressure level of the high-pressure accumulator 7 is determined via a rail pressure sensor 10. Lines with connected injectors 8 for each cylinder of internal combustion engine 1 branch off from the high-pressure accumulator 7.

The electronic engine control unit 11 controls and regulates the state of internal combustion engine 1. It comprises the standard components of a micro-computer system, for example microprocessor, I/O components, buffer and memory components (EEPROM, RAM). In the memory components, the operating data relevant for the operation of the internal combustion engine 1 are applied in engine characteristic maps/characteristics. The input variables of the electronic engine control unit 11 represented in FIG. 1 are: the cylinder pressure plST(i), which is measured by pressure sensors 9, pressure pCR of high-pressure accumulator 7, desired output FW, and additional input values that are designated using the collective reference letter E. The triggering signals for the injectors 8, corresponding to start of injection SB and injected fuel quantity ve and triggering signal ADV for throttle valve 5 are represented as starting variables A of the electronic engine control unit 11. The feed to the second pump 6 is adjusted via throttle valve 5.

Figure 2:
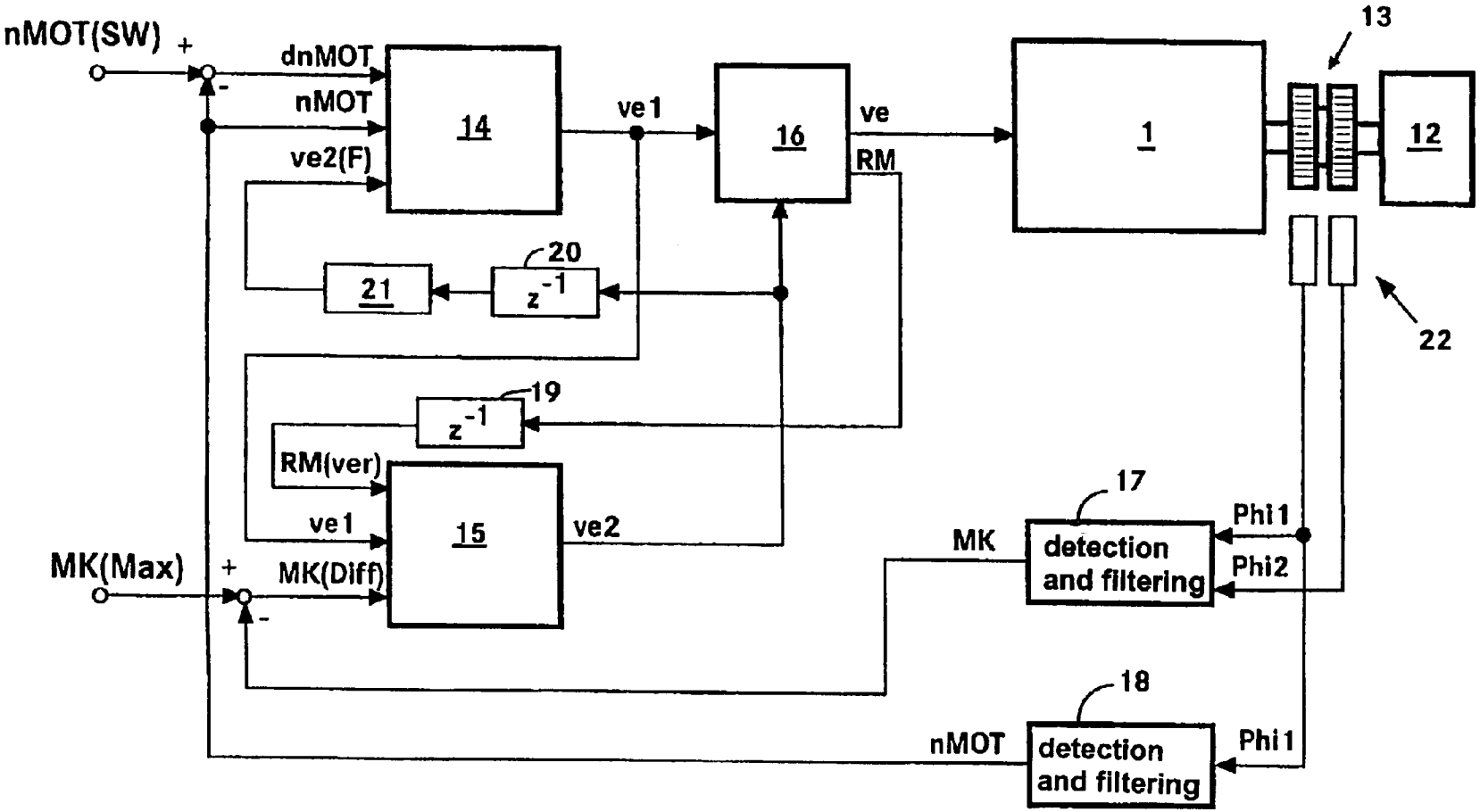
FIG. 2 is a block diagram of first and second controllers.

FIG. 2 shows a block diagram of the control system with a linked closed-loop control circuit structure. It shows: a first controller 14, a second controller 15, a selecting means 16 and the internal combustion engine 1 along with the injection system. The internal combustion engine 1 drives an engine load 12 via a clutch 13, for example a waterjet drive. Tooth angles Phi1 and Phi2 of the clutch 13 are detected by speed sensors 22. The engine speed nMOT is calculated from tooth angle Phi1 via function block Detect/Filter 18. This signal is compared to an engine speed target nMOT (SW) at a subtraction point having the reference variable. In this case target nMOT(SW) represents the input signal characterizing the desired output.

The engine torque MK is determined at the output of internal combustion engine 1 via the function block Detect/Filter 17 from the two tooth angles Phi1 and Phi2. The engine torque MK is compared to a maximum permissible engine torque MK(Max). Maximum permissible engine torque (MK(Max) is determined from input values E, e.g. engine speed nMOT, supercharger speed, charge air pressure pLL, fuel, exhaust and cold water temperature.

As an alternative to the measured engine torque MK, this can also be calculated via a mathematical model. For example, the mathematical model can include a thermodynamic illustration of the internal combustion engine.

The input variables of the first controller 14 are: speed differential dnMOT, engine speed nMOT and a signal ve2 (F). Signal ve2(F) consists of a second signal ve2, with the second signal ve2 being modified via a time-delay element 20 and filter 21. In a simpler embodiment, the second signal ve2 can also be routed directly to first controller 14 or just via the time-delay element 20 or filter 21. The output variable of first controller 14 is signal ve1. This is routed to selecting means 16 and second controller 15. The input variables of second controller 15 are: differential torque MK(Diff), first signal ve1 and a modified controller mode RM(ver). The signal of modified controller mode RM(ver) in turn corresponds to a controller mode RM delayed by a scanning period. The time delay is accomplished via time-delay element 19. The output signal of second controller 15 is second signal ve2. This is routed to selecting means 16 and time-delay member 20.

Selecting means 16 include a minimum value selection. First signal ve1 is set via the minimum value selection as output-determining signal ve, if first signal ve is less than or equal to second signal ve2. In this case controller mode RM is set to a first value. This corresponds to an operation of internal combustion engine in speed mode. Second signal ve2 is set as output-determining signal ve, If second signal ve2 is less than first signal ve1. In this case controller mode RM is set to a second value. This corresponds to an operation of the internal combustion engine in MBR mode. The output signals of selecting means 16 are output-determining signal ve and controller mode RM. Output-determining signal ve is routed to the fuel injection unit of internal combustion engine 1. The "output-determining signal" in the sense of the invention is an injected-fuel quantity or a travel path of a control rod. The structure of first controller 14 is explained in connection with FIG. 7. The structure of second controller 15 is explained in connection with FIGS. 4 through 6.

The function of the control system is as follows:

As long as engine torque MK is clearly less than maximum permissible engine torque MK(Max), second controller 15 does not engage in first controller 14. This is guaranteed by the integral-action component (I-component) of second controller 15 being set to the value of first signal ve1 calculated from first controller 14. Since differential torque MK(Diff) is positive, the integral-action component of second controller 15, e.g. in using a proportional-plus-integral controller, is added with a positive proportional component (P-component). Second signal ve2, calculated by second controller 15, is thus greater than first signal ve1. Consequently, internal combustion engine remains in speed mode. Only after engine torque MK climbs further and approaches maximum permissible engine torque MK(Max) is the integration operation of the integral-action component of second controller 15 started. This enables a disturbance-free transition from the first controller 14 to the second controller 15 since the integral-action component of second controller 15 can now run freely and is no longer set. If second signal ve2 is less than first signal ve1, then the internal combustion engine switches from speed mode into MBR mode.

Second signal ve2 calculated by second controller 15 is used for the limitation of the integral-action component of first controller 14. However, the limitation of the integral-action component of first controller 14 occurs with a time-delay because of time-delay element 20 and filter 21. There is thus no feedback of first signal ve1 to the integral-action component of first controller 14. In this regard, the output of first controller 14 and the integral-action component of first controller 14 are dynamically decoupled. This effectively prevents an undesired amplification of the controller dynamics. For example, with a rapid unloading of the internal combustion engine, the output signal of first controller 14, thus first signal ve1, is reduced. In this respect, also the integral-action component of second controller 15 and second signal ve2 are reduced. Without the delaying effect of filter 21, the integral-action component of first controller 14 would under certain circumstances be diminished, which could lead to a further lessening of first signal ve1.

Figure 3:
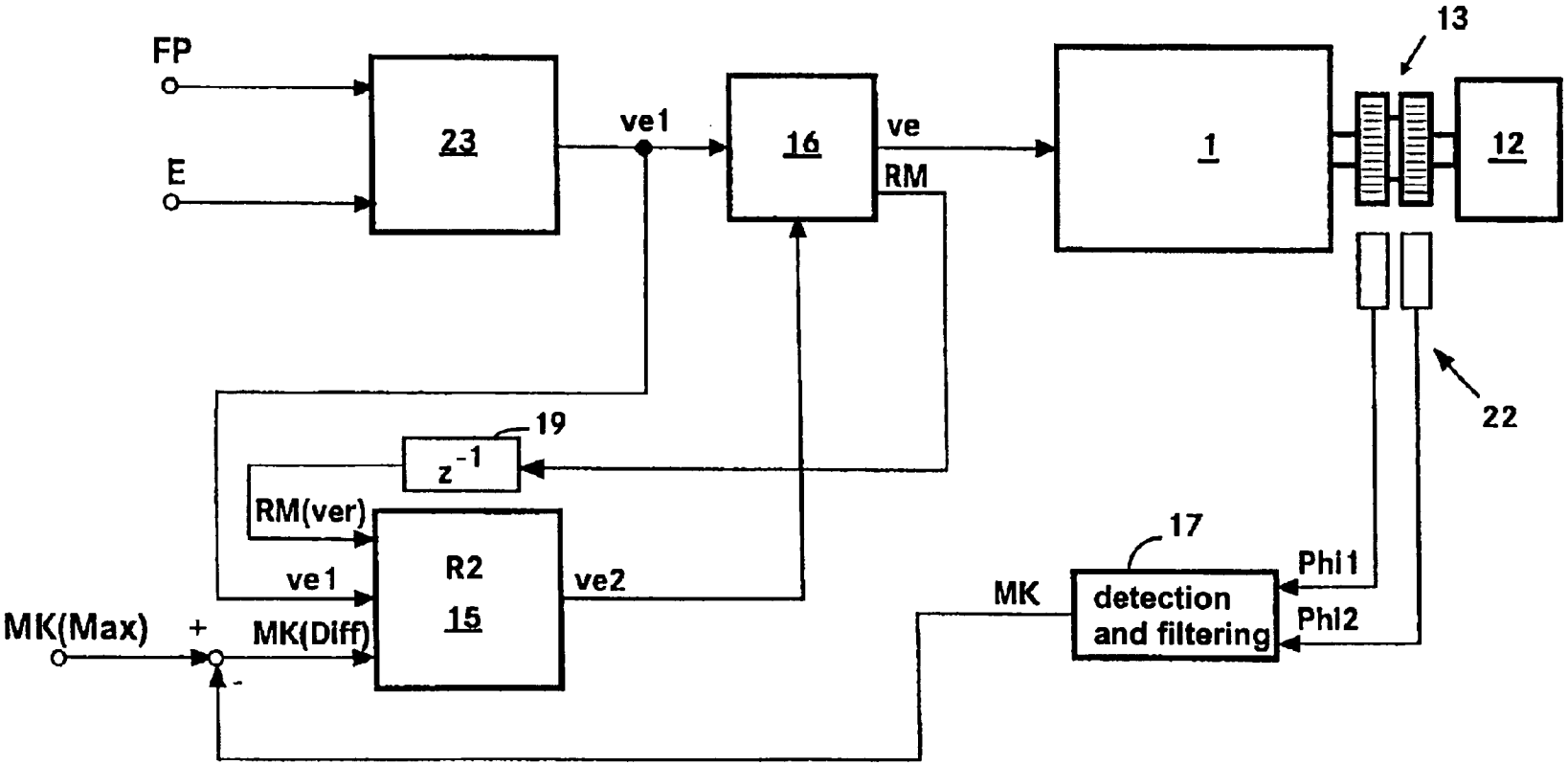
FIG. 3 is a block diagram of function block and the second controller.

FIG. 3 shows an alternative embodiment of the block diagram of FIG. 2. In contrast to FIG. 2, in this block diagram first signal ve1 is calculated via a function block 23 as a function of a desired output, in this case accelerator pedal FP. Function block 23 includes the conversion of the accelerator pedal position into first signal ve1. Corresponding characteristics, including a limit, are provided for this purpose.

The input variables required for the conversion are illustrated using reference character E, for example engine speed nMOT, charge air pressure pLL, etc.

Another difference consists in that the second signal ve2 is routed exclusively to the selecting means 16 in the block diagram according to FIG. 3. Compared to FIG. 2, the target/actual comparison of the engine speed is eliminated since the desired output is predetermined via an accelerator pedal. The rest of the structure corresponds to that of FIG. 2, so what is said there is applicable.

FIG. 4 shows the block diagram of second controller 15, which has an integral-action component and is illustrated by way of example in time-discrete form as a proportional-plus-integral controller. In practice second controller 15 can also be a proportional-plus-integral-plus-derivative controller or as a (PI(DT1) controller. The input variables of second controller 15 are: modified controller mode RM(ver), first signal ve1 and differential torque MK(Diff). The output variable of second controller 15 is second signal ve2. Second controller 15 has as its components a multiplication 25, a function block calculation integral-action component 24 and a summation 26. Proportional component ve2(P) is calculated via multiplication 25. Integral-action component ve2(I) is calculated via function block 24. The structure and mode of functioning of the function block calculation integral-action component 24 is explained in connection with FIGS. 5 and 6. Proportional component ve2(P) is calculated from differential torque MK(Diff) and a proportional-action coefficient kp. Proportional-action coefficient kp can either be preset as constant or be calculated as a function of engine torque MK and the value of second signal ve2, calculated in a previous scanning period. Alternatively, it can also be provided that proportional-action coefficient kp is calculated as a function of engine torque MK and integral-action component ve2(I) in a previous scanning period. By calculating proportional-action coefficient kp, the transmission behavior of second controller 15 can be adapted to various operating conditions, for example different fuel densities or changes in the level of engine efficiency that are a function of the operating point. The dynamic behavior of second controller 15 can be optimized if, in the calculation of the kp value, differential torque MK(Diff) is also taken into consideration.

As illustrated in FIG. 4, second signal ve2 is obtained from the sum of the proportional-action coefficient and the integral-action coefficient, summation 26. For the calculation, the following is therefore applicable:

$$ve2=ve2(P)+ve2(I)$$

with:

ve2 second signal ve2(P) proportional component (P-component)

ve2(I) integral-action component (I-component)

FIG. 6 shows a block diagram for the calculation of integral-action component ve2(I) from FIG. 4. The table of FIG. 5 goes with this figure. The input variables of the block diagram of FIG. 6 are: first signal ve1, modified controller mode RM(ver) and torque differential MK(Diff). The output variable is integral-action component ve2(I) of second signal ve2. The function block calculation of integral-action component 24 includes a first software switch 33 and a second software switch 34. For the positions of first software switch 33, the following relationships are applicable:

1. If delayed controller mode RM(ver) is greater than or equal to the value L2, then input C is active. Value L2 is set as a constant in this case to 1. Delayed controller mode RM(ver) is 1 in speed mode, i.e. in the normal operation of the internal combustion engine.
2. If delayed controller mode RM(ver) is less than value L2, then input D is active. Delayed controller mode RM(ver) is zero in MBR mode.

For second software switch 34, the following relationships are applicable:

1. If the output value of first software switch 33 is greater than or equal to value L1, then input A is active. Value L1 is positive. This can be calculated either from maximum permissible engine torque MK(Max) or be constant, e.g. 150 Nm.
2. If the output value of first software switch 33 is less than value L1, then input B is active.

The positions of first software switch 33 and second software switch 34 illustrated in FIG. 6 correspond to the first row of the Table in FIG. 5. For this case, i.e. first controller 14 is dominant and differential torque MK(Diff) is greater than value L1, positions C/A are active. In these positions integral-action component ve2(I) of second signal ve2 corresponds to first signal ve1. In other words: integral-action component ve2(I) of second signal ve2 is set to the value of first signal ve1. Based on positive differential torque MK(Diff), a likewise positive proportional component ve2(P) results. Altogether, this results in a second signal ve2 whose value is greater than first signal ve1. First signal ve1 is thus set as the output-determining signal via the minimum value selection of selecting means 16.

Now if the differential torque MK(Diff) drops below value L1, i.e. the engine torque of the internal combustion engine develops in the direction of maximum permissible engine torque MK(Max), second software switch 34 changes its position so that input B becomes active. This case corresponds to the second row of the table in FIG. 5. In this position, integral-action component ve2(I) of second signal ve2 is no longer set to the value of first signal ve1, but instead is limited to it via function block minimum value 31. In other words: the integral-action component of second signal ve2 begins to run free. On the second input of function block minimum value 31 the result is routed to a summation 30. The first addend corresponds in this case to the value (time-delay element 32), previously determined in a scanning period, of integral-action component ve2(I) of second signal ve2. The second addend results from multiplication 29 of a factor F by the sum of differential torque MK(Diff) at the current and preceding time, reference numbers 27 and 28. Factor F is calculated as a function of previously described proportional-action coefficient kp, a scanning time TA and an integral-action time TN. The integral action time, in turn, is either constant or represents a function of engine speed nMOT. Consequently, the following correlations are valid:

$$F=f(kp,\ TA,\ TN)$$

and $$TN=f(nMOT);\ TN=\text{constant}$$

From what was previously described, it results that the transition from speed mode to MBR mode always occurs with a free-running integral-action component of second controller 15. In this manner a softer transition from first controller 14 to second controller 15 is ensured, without erratic change of output-determining signal ve.

If current engine torque MK exceeds maximum permissible engine torque MK(Max), then second signal ve2, based on negative differential torque MK(Diff) becomes smaller than first signal ve1. As a result, selecting means 16 sets second signal ve2 as output-determining signal ve and sets controller mode RM to the second value, in this case zero. The change of modified controller mode RM(ver) results in a change in the position of first software switch 33; input D is now active. This position corresponds to the third row of the table in FIG. 5. A return to speed mode occurs if second signal ve2 is greater than or equal to first signal ve1.

Figure 7:
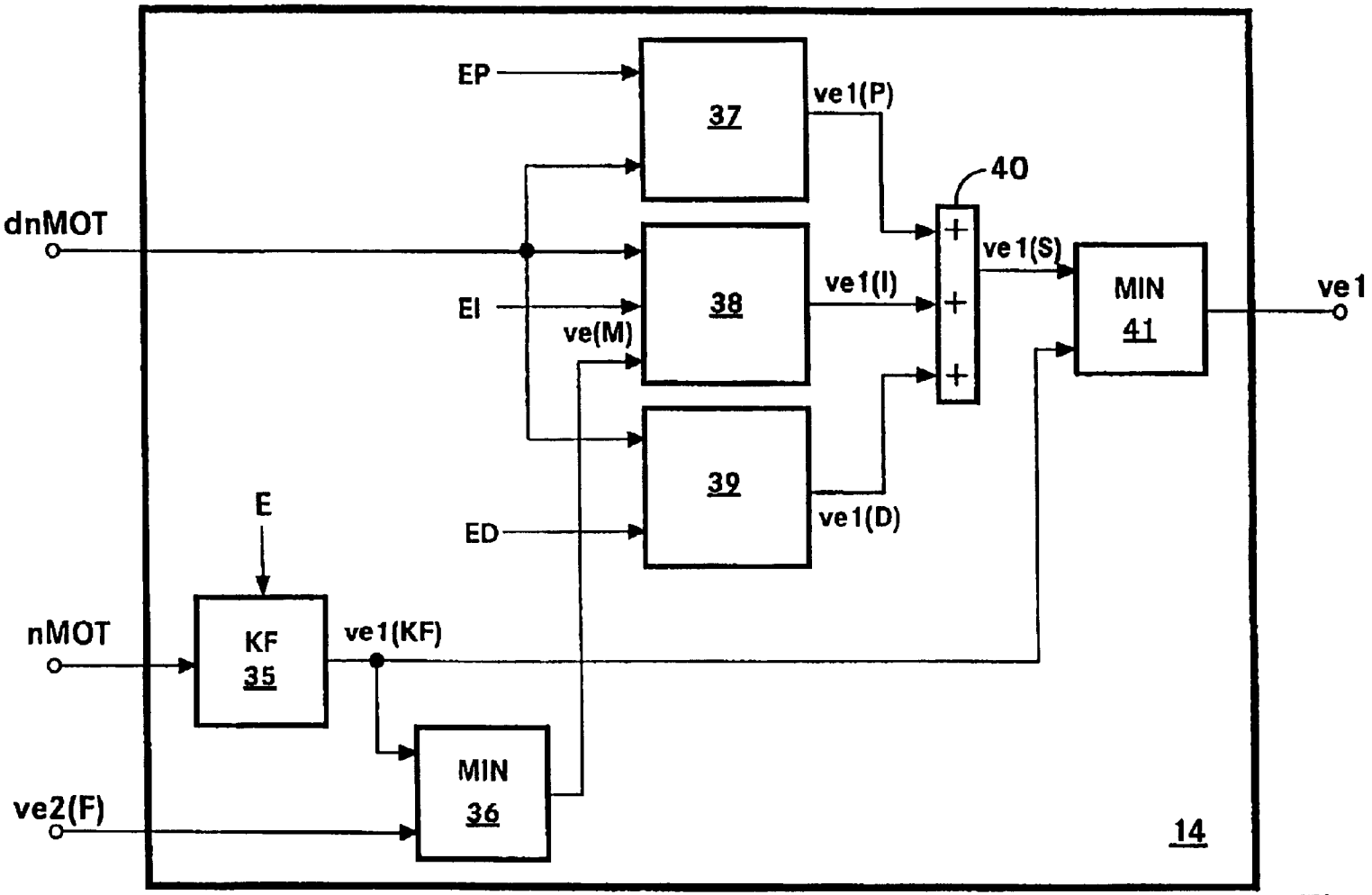
FIG. 7 is a block diagram of first controller.

First controller 14 is depicted in FIG. 7. It has an integral-action component and is depicted by way of example as a PID controller in time-discrete form. In practice the first controller can also be configured as a PI or PI(DT1) controller.

The input variables of first controller 14 are: speed differential dnMOT, engine speed nMOT and modified second signal ve2(F).

The depicted first controller contains three function blocks for the calculation of the proportional-action, integral-action and derivative component, corresponding to reference numbers 37 through 39. Proportional component ve1(P) is determined via function block 37 from an input variable EP and speed differential dnMOT. Integral-action component ve1(I) is calculated via function block 38 from speed differential dnMOT, a first input signal ve(M) and a second input signal EI. In this process, integral-action component is limited to first input signal ve(M). Derivative component ve1(D) is calculated via function block 39 from speed differential dnMOT and an Input variable ED. First input signal ve(M) corresponds either to signal ve2(F) or a signal ve1(KF), according to which signal has the lowest value. A first function block minimum value 36 is provided for this purpose. Signal ve1(KF), in turn, is determined from engine speed nMOT and additional input variables via engine characteristic maps 35. The additional input values are depicted as collective reference character E. Input variables E can be, for example, charge air pressure pLL, etc. All three components are totaled for a common signal ve1(S) via a summation 40. A selection is then made via second function block minimum value 41 between this signal ve1 (S) and signal ve1(KF), depending on which has the lowest value. This signal corresponds to first signal ve1.

Second signal ve2=calculated by second controller 15, affects the calculation of integral-action component ve1(I) of first controller 14. However, based on filter 21, signal ve2(F) is delayed in time compared to second signal ve2. There is therefore no direct feedback of the output of first controller 14 to integral-action component ve1(I) of first controller 14. Output ve1 of first controller 14 and integral-action component ve1(I) of first controller 14 are dynamically decoupled. In this way an undesired amplification of the controller dynamics is effectively prevented. For example with a rapid unloading of the internal combustion engine, the output signal of first controller 14, thus first signal ve1, diminishes. In this respect the integra-action component of second controller 15 and second signal ve2 also diminish. Without the time-delay effect of filter 21, the integral-action component of first controller 14 would be reduced under certain circumstances, which could lead to a further reduction of first signal ve1.

Figure 8A:
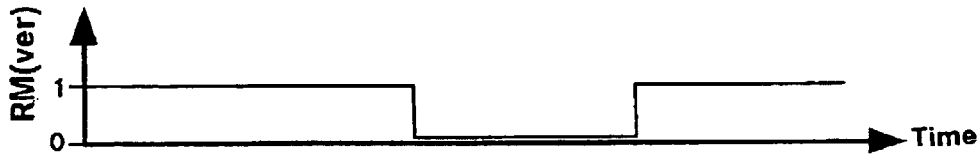
FIGS. 8A–8E are timing diagrams.
Figure 8B:
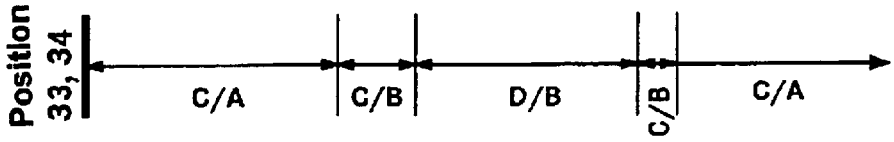
Figure 8C:
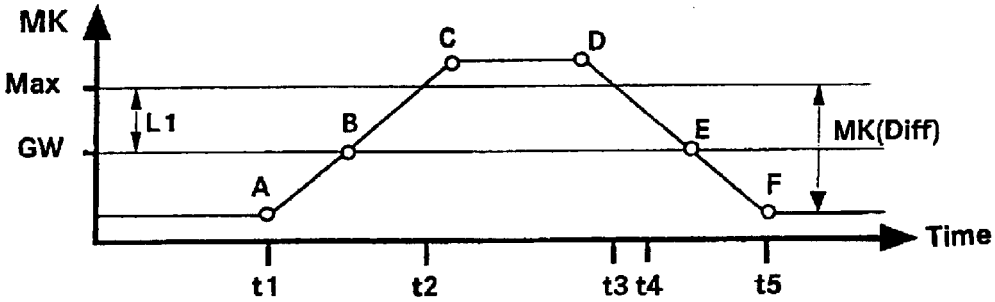
Figure 8D:
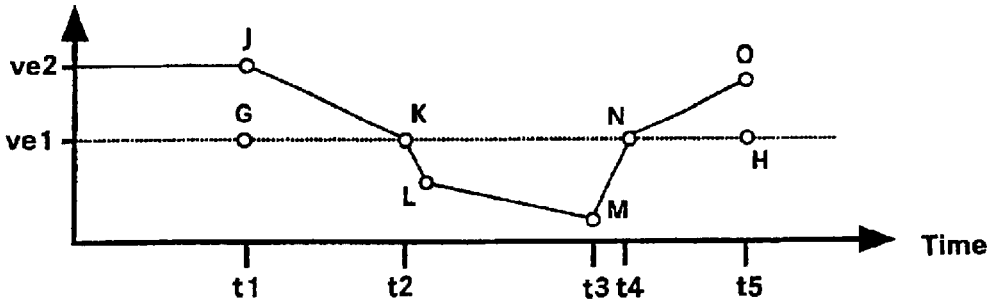
Figure 8E:
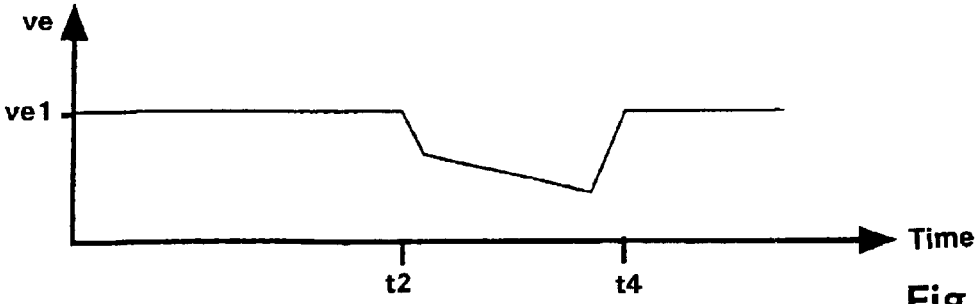

FIG. 8 consists of partial FIGS. 8A through 8E. Depicted over time are the following: modified controller mode RM(ver) (FIG. 8A), engine torque MK (FIG. 8C), first signal ve1 and second signal ve2(FIG. 8D) and output-determining signal ve (FIG. 8E). Depicted in FIG. 8B are positions of first software switch 33 and second software switch 34 at the times in question. Depicted in FIG. 8C parallel to the abscissa are two boundary lines MK(Max) and GW. The difference between two boundary lines corresponds to value L1. Differential torque MK(Diff) results from the difference of the curve trace from points A through F up to maximum permissible engine torque MK(Max). In FIG. 8D the curve of second signal ve2 is depicted as a continuous line. First signal ve1 is depicted as a dotted line.

The sequence of the process is as follows: at time t1 it is assumed that the internal combustion engine is operated in speed mode. In this mode first signal ve1, calculated by first controller 14, is set by selecting means 16 as output-determining signal ve. The level depicted in FIG. 8E and the curve of output-determining signal ve thus corresponds to the value of first signal ve1. Controller mode RM is set by selecting means 16 to a first value, in this case one. The two software switches 33 and 34 are in position C/A. In this position, integral-action component ve2(I) of second signal ve2 corresponds to the value of first signal ve1. In other words: integral-action component ve2(I) of the second signal is set to the value of first signal ve1. At time t1 there is a positive differential torque. A positive proportional component ve2(P) of second controller 15 likewise results from this. Second signal ve2 is calculated as:

$$ve2=ve1+ve2(P)$$

wherein:

ve2 second signal ve1 first signal ve2(P) proportional component of second signal As depicted in FIG. 8D, the value of second signal ve2, point J, is above the value of first signal ve1, Point G. For the further course it is assumed that first signal ve1 remains constant At time t1 it is then assumed that engine torque MK on the output of the internal combustion engine increases, i.e. the course of the curve in FIG. 8C changes at point A in the direction of point C. Based on diminishing differential torque MK (Diff) proportional component ve2 (P) of second signal ve2 likewise decreases. Integral-action ve2(I) of second signal ve2 is still set to the value of first signal ve1. The calculated value of second signal ve2 therefore lies above that of first signal ve1, i.e. at a greater value. At point B of FIG. 8C, differential torque MK(Diff) is equal to value L1. Upon exceeding this line, software switch 34 changes its position. This is depicted in FIG. 8B with the change of positions from C/A and C/B. From this time, integral-action component ve2(I) of second signal ve2 is no longer set to the value of first signal ve1, but is limited just to the value of first signal ve1. The integral-action component of second controller 15 thus begins to run freely starting at this time.

At time t2 a differential torque MK(Diff) of zero results. From this it leads to the fact that proportional component ve2(P) of second signal ve2 is also zero. At this time the value of second signal ve2 corresponds to the value of first signal ve1, point K in FIG. 8D. If now differential torque MK(Diff) exceeds maximum permissible engine torque MK(Max), this causes a change of sign of differential torque MK(Diff). Consequently, the second signal ve2 henceforth has a lower value than first signal ve1. As a reaction to this, selecting means 16 change controller mode RM from 1 to 0 and sets second signal ve2 as output-determining signal ve. In addition, the two software switches 33 and 34 change their positions to D/B. In the time period t2 to t4, based on the assumed curve of differential torque MK(Diff), a corresponding curve of signal ve2 results in accordance with curve trace K to N. Since the internal combustion engine henceforth operates in MBR mode, the curve of output-determining signal ve corresponds to the curve of second signal ve2.

At time t4 it is then assumed that the value of second signal ve2 corresponds to the value of first signal ve1. The selecting means 16, based on the minimum value selection, sets controller mode RM back to the first value, in this case one, and sets first signal ve1 as output-determining signal ve.

Starting at time t4, the curve of output-determining signal ve thus corresponds to the curve of first signal ve1, i.e. ve remains constant, as depicted in FIG. 8E. Due to the change of controller mode RM, the positions of both software switches 33 and 34 change to C/B.

At point E differential torque MK(Diff) again corresponds to the value L1. Thus the position of second software switch 34 changes, i.e. the two software switches 33 and 34 henceforth assume the position C/A. In this position integral-action component ve2(I) of second signal ve2 is set to the value of first signal ve1. Corresponding to the further course of differential torque MK(Diff) this results in a curve following curve trace N through O for the second signal ve2. At time t5, the considered time frame is terminated.

Figure 9:
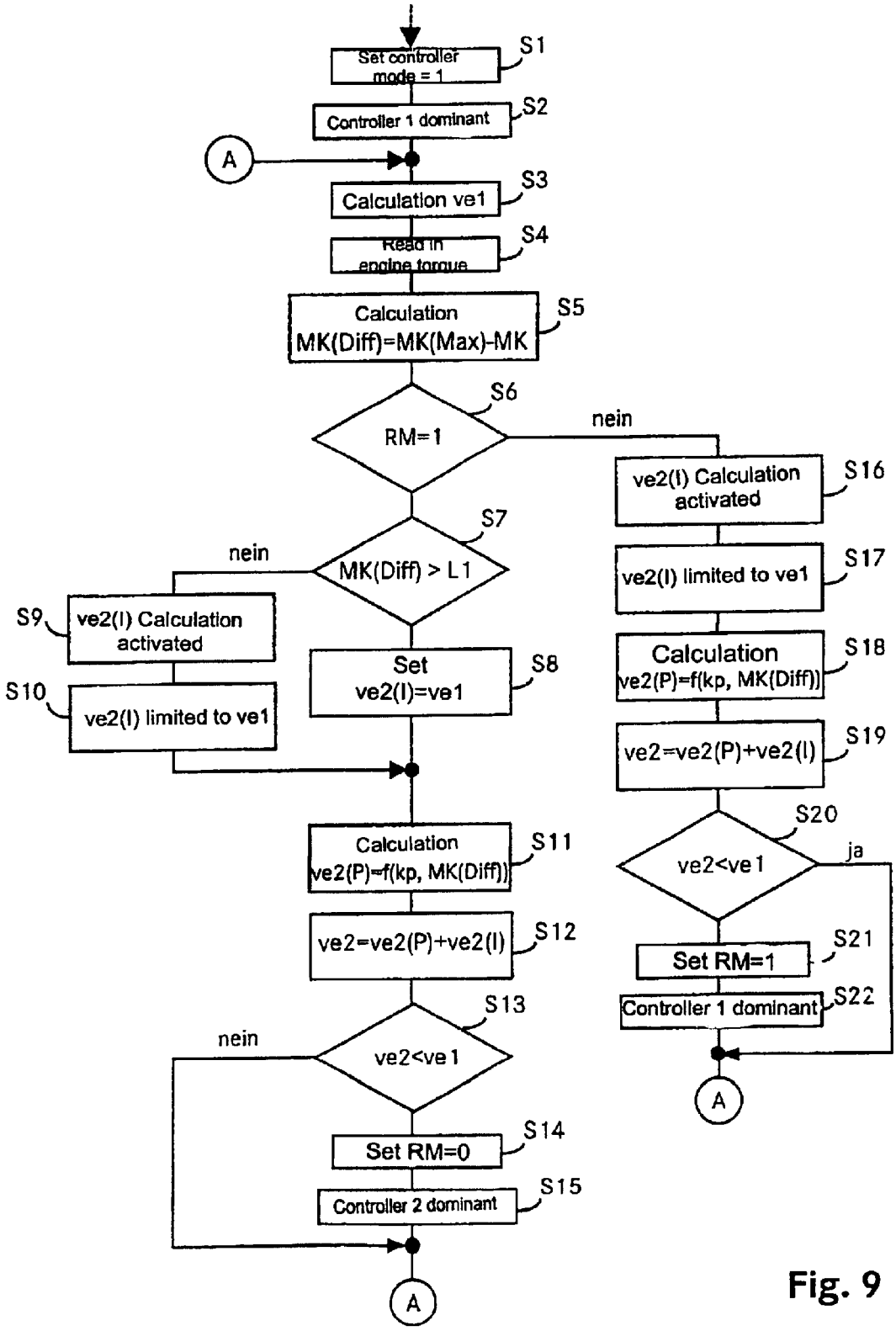
FIG. 9 is a program flowchart.

Depicted in FIG. 9, a program flowchart of the method according to the invention. In step S1 controller mode RM is initialized with 1, since at the startup of internal combustion engine there is still no engine torque. In the starting state, the internal combustion engine is operated in speed mode. In step S2 the first controller is dominant, i.e. first signal ve1 is set as output-determining signal ve.

In steps S3 and S4, first signal ve1 is calculated and current engine torque MK is read in. Then in step S5 differential torque MK(Diff) is calculated from the current engine torque MK and a maximum permissible engine torque MK(Max). In step S6 a check is performed as to whether controller mode RM is equal to 1, i.e. whether the internal combustion engine is still in speed mode. If this is not the case, i.e. the internal combustion engine is in MBR mode, steps S16 to S22 are carried out. If the check reveals that the internal combustion engine is operated in speed mode, then at step S7 the query of whether differential moment MK(Diff) is larger than value L1 is made.

In the event of a positive check result, integral-action component ve2(I) of second signal ve2 is set to first signal ve1 in step S8. In the event of a negative check result, in step S7 the calculation of integral-action component ve2(I) of second signal ve2 is activated in S9. In step S10, the integral-action component ve2(I) of the second signal ve2 is limited to the value of first signal ve1. In step S11, proportional share ve2(P) of second signal ve2 is calculated as a function of differential torque MK(Diff) and a proportional coefficient kp. In step S12, second signal ve2 is determined via the addition of the proportional and integral-action components. Then in step S13 a check is made as to whether second signal ve2 is smaller than first signal ve1. If this is not the case, then the program branches to point A. If it is determined in step S13 that the value of second signal ve2 is smaller than the value of first signal ve1, then controller mode RM is set to a second value, in this case zero, via selecting means 16. Via selecting means 16, second signal ve2 is henceforth set as output-determining signal ve, i.e. second controller 15 is dominant. Then the program flow chart branches at point A with the new calculation of first signal ve1.

If it is determined in step S6 that the internal combustion engine is in MBR mode, then the calculation of integral-action component ve2(I) of second signal ve2 is activated at step S16. The integral-action component in this process is limited to the value of first signal ve1 in step S17. Then the proportional component is calculated as previously described in step S18. Second signal ve2 is determined from the proportional and integral-action components in step S19. In step S20 a check is made as to whether the value of the second signal ve2 is smaller than the value of first signal ve1. If this is the case, then the program flow chart branches to point A. If the result of the check is negative, i.e. second signal ve2 is not smaller than first signal ve1, controller mode RM is set to a first value, in this case 1. Then in step S22 first signal ve1 is set as output-determining signal ve, i.e. the first controller 14 is dominant.

What is claimed is:

1. A control system for protecting an internal combustion engine from overloading, the control system comprising: an input signal, wherein the control system computes an output-determining signal for setting an output of the engine as a function of the input signal, wherein the control system computes a differential torque from current engine torque and a maximum permissible engine torque, wherein the control system determines a first signal from the input signal, wherein the control system determines a second signal substantially by the differential torque, and wherein the control system sets one of the first signal and the second signal as the output-determining signal.

2. The control system as recited in claim 1, further comprising a selecting element that includes a minimum value selection, wherein the first signal is set as the output-determining signal if the first signal is less than or equal to the second signal, and the second signal is set as the output-determining signal if the second signal is less than the first signal.

3. The control system as recited in claim 2, further comprising a controller mode that is set to a first value via the selecting element if the first signal is dominant and is set to a second value if the second signal is dominant.

4. The control system as recited in claim 2, wherein the first signal is determined by a first controller from an engine speed, a speed differential and the second signal.

5. The control system as recited in claim 1, further comprising a function block, wherein the first signal is determined by the function block from an accelerator pedal value and additional input variables.

6. The control system as recited in claim 4, further comprising a second controller, wherein the second signal is also determined by the second controller from a controller mode and the first signal.

7. The control system as recited in claim 6, wherein the first signal is routed to the second controller.

8. The control system as recited in claim 6, wherein the second controller has an output that is routed to the first controller and the selecting element.

9. The control system as recited in claim 8, further comprising at least one of a time-delay element and a filter arranged in a signal path from the second controller to the first controller.

10. The control system as recited in claim 9, further comprising a modified second signal, which is derived by the at least one of the time-delay element and the filter from the second signal, and is an input variable of the first controller.

11. The control system as recited in claim 6, wherein the selecting element has an output that is directed to the second controller.

12. The control system according to claim 11, further comprising a time-delay element arranged in a signal path from the selecting element to the second controller.

13. The control system as recited in claim 12, further comprising a modified controller mode, which is determined by the time-delay element and represents an input value of the second controller.

14. The control system as recited in claim 13, wherein the second controller includes an integral-action controller calculating an integral-action component, and the second signal is calculated from the integral-action component.

15. The control system as recited in claim 14, wherein the integral-action component is set to the value of the first signal if the differential torque is greater than or equal to a third value one of the controller mode and the modified controller mode corresponds to the first value.

16. The control system as recited in claim 14, wherein the integral component is limited to the value of the first signal if the differential torque is smaller than at least one of a third value or one of the controller mode and the modified controller mode corresponds to the second value.

17. The control system as recited in claim 16, wherein, in the calculation of the integral-action component, an integral-action time is considered and the integral-action time is one of a constant and a function of an engine speed.

18. The control system as recited in claim 16, wherein the third value is calculated as a function of the maximum permissible engine torque.

19. The control system as recited in claim 16, wherein the third value is calculated as a function of engine speed.

20. The control system as recited in claim 14, wherein the second controller includes a proportional-action controller, which calculates a proportional component, and the second signal is calculated from the proportional component.

21. The control system as recited in claim 20, wherein the proportional component (ve2(P)) is calculated as a function of the differential torque (MK(Diff)) and a proportional-action coefficient (kp) (ve2(P)=f(MK(Diff), kp)).

22. The control system as recited in claim 21, wherein the proportional-action coefficient is at least one of constant, a function of at least the engine torque and a function of at least the differential torque.

23. The control system as recited in claim 21, wherein the proportional coefficient is a function of at least one of the second signal and the integral-action component.

24. The control system as recited in claim 6, wherein the first controller includes at least an integral-action controller, said integral-action controller calculating an integral-action component as a function of a first input signal, a second input signal and the speed differential.

25. The control system as recited in claim 24, wherein the second controller also has a first function block minimum value, a second function block minimum value and.engine characteristics maps.

26. The control system as recited in claim 25, wherein the first input signal is determined by the first function block minimum value from at least one of the second signal, the modified second signal and an engine-characteristics-map signal calculated by the engine characteristics maps.

27. The control system as recited in claim 26, wherein the engine-characteristic-map signal is calculated as a function of the engine speed and additional input values.

28. The control system as recited in claim 27, wherein the first signal is determined via the second function block minimum value from at least one of the engine-characteristic-map signal and at least from the integral-action component.

29. The control system as recited in claim 1, wherein the differential torque is calculated from measured input values by a mathematical model.

30. A method for protecting an internal combustion engine from overloading, the method comprising:

setting engine output using an output-determining signal as a function of a desired output;

calculating a differential torque from an engine torque and a maximum permissible engine torque;

calculating a first signal from an input signal;

calculating a second signal from the differential torque; and setting one of the first and second signal as the output-determining signal.

31. The method as recited in claim 30, comprising:

setting the first signal as the output-determining signal if the first signal is less than or equal to the second signal; and setting the second signal as the output-determining signal if the second signal is less than the first signal.

32. The method as recited in claim 31, comprising:

setting a controller mode to a first value using a selecting element containing a minimum value selection if the first signal is dominant; and setting a controller mode to a second value using the selecting element if the second signal is dominant.

33. The method as recited in claim 30, comprising:

determining the first signal via a first controller from an engine speed, a speed differential and the second signal.

34. The method as recited in claim 30, comprising:

determining the first signal via a function block from an accelerator pedal value and additional input variables.

35. The method as recited in claim 33, comprising determining the second signal via a second controller from a controller mode and the first signal.

36. The method as recited in claim 35, comprising:

routing the first signal to the second controller.

37. The method as recited in claim 35, comprising:

routing an output of the second controller to the first controller and the selecting element.

38. The method as recited in claim 37, comprising:

arranging at least one of a time-delay element and a filter in a signal path from the second controller to the first controller.

39. The method as recited in claim 38, comprising:

making a modified second signal, which is derived via at least one of the time-delay element and the filter from the second signal, an input variable of the first controller.

40. The method as recited in claim 35, comprising:

directing an output of the selecting element to the second controller.

41. The method according to claim 40, comprising:

arranging a time-delay element in the signal path from the selecting element to the second controller.

42. The method as recited in claim 41, comprising:

making a modified controller mode, which is determined via the time-delay element, an input value of the second controller.

43. The method as recited in claim 42, wherein the second controller includes an integral-action controller calculating an integral-action component, and the second signal from the integral-action component.

44. The method as recited in claim 43, comprising:

setting the integral-action component to the value of the first signal if the differential torque is greater than or equal to a third value, and setting one of the controller mode and the modified controller mode to the first value.

45. The method as recited in claim 43, comprising:

limiting the integral-action component to the value of the first signal if the differential torque is smaller than a third value, and setting one of the controller mode and the modified controller mode to the second value.

46. The method as recited in claim 45, wherein in the calculation of the integral-action component, an integral-action time is considered and the integral-action time is one of a constant and a function of the engine speed.

47. The method as recited in claim 45, comprising:

calculating the third value as a function of the maximum permissible engine torque.

48. The method as recited in claim 44, comprising:

calculating the third value as a function of engine speed.

49. The method as recited in claim 43, comprising:

configuring the second controller as a proportional-action controller, which calculates a proportional component, and calculating the second signal from the proportional component.

50. The method as recited in claim 49, comprising:

calculating the proportional component as a function of the differential torque and a proportional-action coefficient.

51. The method as recited in claim 50, wherein the proportional-action coefficient is one of a constant, a function of at least the engine torque, and a function of at least the differential torque.

52. The method as recited in claim 50, comprising:

calculating the proportional coefficient as a function of at least one of the second signal and the integral-action component.

53. The method as recited in claim 35, comprising:

configuring the first controller as at least an integral-action controller that calculates an integral-action component as a function of a first input signal, a second input signal and the speed differential.

54. The method as recited in claim 53, wherein the second controller has a first function block minimum value, a second function block minimum value and engine characteristics maps.

55. The method as recited in claim 54, comprising:

determining the first input signal via the first function block minimum value from one of the second signal and the modified second signal, and calculating an engine-characteristics-map signal via the engine characteristics maps.

56. The method as recited in claim 55, comprising:

calculating the engine-characteristic-map signal as a function of the engine speed and additional input values.

57. The method as recited in claim 56, comprising:

determining the first signal via the second function block minimum value from at least one of the engine-characteristic-map signal and the integral-action component.

58. The method as recited in claim 30, comprising:

calculating the differential torque from measured input values via a mathematical model.

* * * * *